US005891515A

United States Patent [19]

Dutheil et al.

[11] Patent Number: 5,891,515

[45] Date of Patent: Apr. 6, 1999

[54] PROCESS FOR COATING METAL SUBSTRATES WITH PRIMER AND COATING POWDERS

[75] Inventors: Jean-Yves Dutheil, Le Tilleul othon; Eric Perraud, Bernay, both of France

[73] Assignee: Elf Atochem S.A., Puteaux, France

[21] Appl. No.: 462,555

[22] Filed: Jun. 5, 1995

Related U.S. Application Data

[63] Continuation of Ser. No. 34,163, Mar. 19, 1993, abandoned, which is a continuation of Ser. No. 847,414, Mar. 5, 1992, abandoned, which is a continuation of Ser. No. 431,596, Nov. 3, 1989, abandoned.

[30] Foreign Application Priority Data

Nov. 3, 1988 [FR] France ..... 88 14332

[51] Int. Cl.[6] ..... B05D 1/22

[52] U.S. Cl. ..... 427/185; 427/195; 427/201; 427/203; 427/461; 427/470; 427/486

[58] Field of Search ..... 427/195, 201, 427/202, 203, 185, 461, 470, 486

[56] References Cited

U.S. PATENT DOCUMENTS

| | | | |
|---|---|---|---|
| 3,203,822 | 8/1965 | Junker et al. | 427/185 |
| 3,502,492 | 3/1970 | Spiller | 138/146 |
| 3,904,346 | 9/1975 | Shaw et al. | 427/184 |
| 3,982,050 | 9/1976 | Kato et al. | 427/203 |
| 3,998,716 | 12/1976 | Masar et al. | 427/470 |
| 4,034,703 | 7/1977 | Scheiber et al. | 118/67 |
| 4,104,416 | 8/1978 | Parthasarathy et al. | 427/195 |
| 4,251,426 | 2/1981 | McClure et al. | 525/934 |
| 4,268,579 | 5/1981 | Suzuki et al. | 427/202 |
| 4,351,914 | 9/1982 | Khanna | 523/448 |
| 4,888,407 | 12/1989 | Yasuhisa et al. | 525/423 |
| 4,910,046 | 3/1990 | Herwig et al. | 427/195 |

FOREIGN PATENT DOCUMENTS

| | | | |
|---|---|---|---|
| 702044 | 1/1965 | Canada . | |
| 746457 | 11/1966 | Canada | 427/185 |
| 2097592 | 3/1972 | France | 427/486 |
| 2340140 | 9/1977 | France . | |
| 63-283780 | 11/1988 | Japan | 427/185 |
| 110396 | 12/1960 | Pakistan | 427/185 |
| 838738 | 6/1960 | United Kingdom | 427/185 |
| 900149 | 7/1962 | United Kingdom | 427/185 |
| 927287 | 5/1963 | United Kingdom | 427/195 |

*Primary Examiner*—Erma Cameron

*Attorney, Agent, or Firm*—Burns, Doane, Swecker & Mathis, L.L.P.

[57] ABSTRACT

A process for preparing a metal plastic composite comprising prime coating at least a portion of a metal substrate with one or more layers of an adhesion primer powder consisting of a solid thermosetting resin using a conventional powder application technique, heating the thus coated substrate to a temperature sufficient to melt a surface coating powder to be subsequently applied, immersing the thus coated substrate into a fluidized bed of a surface coating powder for a time sufficient to give the thickness of surface coating desired.

8 Claims, No Drawings

PROCESS FOR COATING METAL SUBSTRATES WITH PRIMER AND COATING POWDERS

This application is a continuation, of application Ser. No. 08/034,163, filed Mar. 19, 1993, now abandoned, which is continuation, of application Ser. No. 07/847,414, filed Mar. 5, 1992, now abandoned, which is a continuation of Ser. No. 07/431,596, filed Nov. 3, 1989, now abandoned.

BACKGROUND OF THE INVENTION

The present invention relates to a process for coating a metal substrate with a surface coating applied by a fluidized-bed process after the said substrate has been coated with a primer powder.

The fluidized-bed immersion process requires a preliminary preheating of the metal article to be coated before it is immersed in the porous-bottomed vessel in which the coating powder in suspension is kept in suspension by circulating air. The powder then melts in contact with the hot metal surfaces and forms a deposit whose thickness is a function of the temperature of the substrate and of its period of immersion in the powder.

The preheating of the metal article usually takes place in an oven at a temperature which is determined primarily according to the nature and the thickness of the article to be coated.

However, for a given article, there is a minimum temperature below which it is not possible to obtain a coating of good quality from the viewpoint of its appearance and of its adhesion to the substrate.

However, on the other hand, an excessively high preheating temperature can be detrimental, more particularly in the case where the metal article has been coated beforehand with an adhesion primer which can be adversely affected by the temperature when the article passes through the oven and can no longer ensure the adhesion to the surface coating and to the metal substrate.

At the present time, the adhesion primers for surface coatings which are applied by immersion in a fluidized bed of surface coating powders exist exclusively in liquid form. That is to say, the primer resins are either in suspension or in solution in one or more solvents. The coating of metal substrates with these liquid primers is done, for example, with the aid of a pneumatic gun.

These solvents, frequently toxic to the environment, make it necessary to provide recovery and/or recycling systems thus entailing an additional plant cost.

SUMMARY OF THE INVENTION

Adhesion primers have now been found which overcome these problems and are in the form of powder compositions capable of being applied, as such, to metal substrates and permit fluidized-bed coating of substrates with strongly adherent surface coatings.

Briefly, the present invention provides a process for coating metal substrates comprising applying an adhesion primer powder onto the portion of said substrate desired to be coated, said primer based on epoxy resin(s) and hardeners for epoxy resin(s) and then applying a surface coating by inserting said primer portion fluidized bed of a surface coating powder.

The invention also comprises novel adhesion primers and the resultant metal-plastic composites as hereinafter described.

DETAILED DESCRIPTION

The instant process is characterized in that it comprises the following stages;

(a) coating a portion or the entire substrate with one or more layers of an adhesion primer powder using any conventional powder application technology, (b) heating the substrate, and, immediately afterwards, (c) application of the surface coating powder by immersion into a fluidized bed of such powder.

The metal substrate, which may have been subjected beforehand to one or more surface treatments such as alkali degreasing, brushing, shot-blasting, phosphatizing, hot rinsing, etc., is coated with one or more layers of adhesion primer powder.

The metal substrate may be chosen from a wide range of products. For example, those involved may be ordinary or galvanized steel articles or aluminum or aluminum alloy articles, with the invention being aimed more particularly at steel articles.

Although the thickness of the metal substrate is not critical in itself, in most cases it will lie between 1 to 50 mm.

The application of the primer powder composition according to the invention can be carried out using any conventional powder application technique. Among the powder application techniques there may be mentioned electrostatic spraying, a technique which is particularly preferred for applying the primer according to the present invention, and immersion into a fluidized bed.

In electrostatic spraying the powder is introduced into a gun, where it is conveyed by compressed air and travels through a nozzel raised to a high voltage, generally between about ten and about a hundred kilovolts. The applied voltage may be positive or negative in polarity, negative polarity being generally preferred.

The flow rate of the powder in the gun is generally between 10 and 200 g/min.

Powders with a mean particle size of between 5 and 100 $\mu$m and preferably between 5 and 80 $\mu$m can generally be employed.

The mean thickness of the primer particles may be between 5 and 60 $\mu$m and preferably between 10 and 20 $\mu$m.

The powder compositions which form the adhesion primer in accordance with the invention are based on solid thermosetting resins and preferably based on epoxy resins and on hardener(s) for epoxy resin(s).

A thermosetting resin means, in the present description, epoxy resins, phenolic resins and epoxyphenolic precondensates, by themselves or mixed.

By way of example of advantageously preferred epoxy resins there may be mentioned the products obtained by reaction of bisphenol A and of epichlorohydrin, in which the degree of polymerization is higher than two, as well as high molecular weight polycondensates of phenoxy type without a free reactive group.

As an example of advantageously preferred phenolic resins there may be mentioned the resins obtained by the polycondensation of formaldehyde with a phenol.

Among the various solid hardeners for epoxy resin(s), those preferably employed are the compounds of the amine, acid anhydride or isocyanate type.

A compound of the amine type means aliphatic or aromatic amines and their derivatives, such as dicyandiamide, benzyldimethylamine and boron trifluoride monoethylamine.

As an example of an acid anhydride there may be mentioned aromatic anhydrides such as phthalic anhydride or cycloaliphatic anhydrides such as hexahydrophthalic anhydride.

A compound of the isocyanate type means a monomeric, prepolymeric or polymeric compound containing at least two free or blocked isocyanate groups. Polyisocyanate compounds with an aromatic or aliphatic structure in which the isocyanate groups are blocked by condensation with phenol or caprolactam are particularly preferred.

The proportion of epoxy resin(s) and of hardener(s) of the amine acid anhydride or isocyanate type must be such as to make the number of epoxy functional groups equal to the number of the reactive functional groups of the amine, the acid anhydride, or of the isocyanate compound.

However, for reasons of coating quality, it may be preferred to vary the stoichiometric proportion given above between 0.1 and 1.5 reactive amine, anhydride or isocyanate functional groups per epoxy functional group.

The primers in accordance with the invention may also contain various additives and agents, by themselves or mixed, such as pigments, fillers, corrosion inhibitors, etc. Among the compounds which are usually encountered there may be mentioned strontium chromate, zinc phosphate, titanium dioxide and silica. These are added in their usual amounts and for their usual effects.

Once the application of the primer to the substrate is completed, the substrate is heated, as by being placed in an oven, to a specified temperature, based particularly on the nature of the said substrate, its shape, and the desired surface coating thickness. The particular temperature that is optimum for any given combination of metal substrate, primer, surface coating material and thickness can be determined by routine experimentation. In addition to the crosslinking of the primer, the energy stored while the primer-coated substrate is put through the oven permits the melting and the adhesion of the surface coating applied by immersion into a fluidized bed of the surface coating powder as soon as the substrate leaves the oven.

The powder adhesion primers of the present invention stand up particularly well to the elevated temperatures which may be necessary to ensure and effective preheating of the substrate to be coated.

This is not the case with the liquid primers, for which an excessively elevated temperature is detrimental to the resulting adhesion of the final coating. This is why the normal conditions of use of the liquid primers are limited to the coating of metal articles of such geometrical configuration that the temperature of the preheating which is necessary before dipping is below 270°–320° C.

The primer powders according to the invention can not only be heated to 270°–320° C., but can be subjected to heating to higher temperatures such as, for example, between 320° and 380° C. when necessary, without damaging the quality of the final coating.

The average residence time of the substrate in the heating means, such as an oven, is generally between 1 and 30 minutes and preferably between 3 and 10 minutes.

As soon as it leaves the oven, the substrate is immersed in a dipping vessel containing fluidized bed of the surface coating powder such as defined above.

The surface coating powders, applied by dipping and in accordance with the invention are preferably based on polyamide and/or polyetheresteramide.

A polyamide forming part of the surface coating powder according to the invention means the aliphatic polyamides obtained from lactams or amino acids whose hydrocarbon chain contains a number of carbon atoms which is between 4 and 20, such as, for example, caprolactam, oenantholactam, dodecanolactam, undecanolactam, 11-aminoundecanoic acid, 12-aminodedocanoic acid, products of condensation of a dicarboxylic acid with a diamine, such as, for example, polyamides 66, 610, 612 and 96 (products of the condensation of hexamethylenediamine with adipic acid, azelaic acid, sebacic acid and 1,12-dodecanedioic acid and of nonamethylenediamine with adipic acid) and the copolyamides resulting from the polymerization of the various monomers mentioned above or mixtures of several polyamides mentioned above.

Among these polyamides there will be mentioned-most particularly:

(a) polyamide 11 (PA-11), obtained by polycondensation of 11-aminoundecanoic acid, (b) polyamide 12 (PA-12), obtained by polycondensation of 12-aminododecanoic acid or of dodecanolactam, and (c) the copolyamides obtained by the polymerization of the abovementioned monomers.

As a general rule, the inherent viscosity (measured at 20° C. on a solution containing 0.5 g per 100 g of meta-cresol) of the polyamides may be between 0.20 and 2.0, and preferably between 0.60 and 1.30 dl $g^{-1}$.

Polyamides also means the semiaromatic amorphous polyamides, and especially those such as defined in French Patents FR 1,588,130, 2,324,672 and 2,575,756, in European Patent EP 53,876 and in Japanese Patents 59-015,447 and 60-217,237.

Polyetheresteramides mean both random polyetheresteramides (that is to say those formed by random concatenation of various monomeric constituents) and block polyetheresteramides, that is to say those made up of blocks having a certain chain length of their various constituents.

The polyetheresteramides are products of the copolycondensation of polyamide blocks containing reactive ends with polyether blocks containing reactive ends, such as polyamide blocks containing dicarboxylic chain ends with polyetherdiol blocks.

The number-average molecular mass of these polyamide blocks is generally between 500 and 10,000 and more particularly between 600 and 5,000. The polyamide blocks of the polyetheresteramides are preferably made up of polyamide 6, 66, 612, 11 or 12, or of copolyamides resulting from the polycondensation of their monomers.

The number-average molecular mass of the polyethers is generally between 200 and 6,000 and more particularly between 600 and 3,000.

The polyether blocks preferably consist of polytetramethylene glycol (PTMG), polypropylene glycol (PPG) or polyethylene glycol (PEG).

The inherent viscosity of the polyetheresteramides is advantageously between 0.8 and 2.05 and preferably between 0.80 and 1.20.

The inherent viscosity is measured in meta-cresol at 25° C. with an initial concentration of 0.5 g per 100 g of meta-cresol. It is expressed in dl $g^{-1}$.

The polyetheresteramides according to the invention may be made up of 5 to 85% by weight of polyether and of 95 to 15% by weight of polyether and of 70 to 20% by weight of polyamide.

The particle size of the surface coating powders may be between 20 and 300 $\mu$m and preferably between 40 and 200 $\mu$m.

The dipping technique according to the invention is conducted in a nonelectrostatic fluidized bed, electrostatic fluidized beds being ill adapted and difficult to apply for dipping in polyamide-based and/or polyetheresteramide-based powders which are particularly preferred.

The thickness of the surface coating may be generally between 150 and 600 $\mu$m and preferably between 200 and 400 $\mu$m.

Once the dipping operation is finished, the substrate is cooled, for example in ambient air or by immersion in water or in any other suitable solvent, after it has optionally been subjected to a postmelting.

The following examples further describe the invention and are for purposes of illustration only, they do not limit the invention.

EXAMPLE 1

A. CONSTITUENTS

1. The metal substrate consists of a steel plate 1 mm in thickness. This plate has previously undergone degreasing followed by shot-blasting.

2. The primer powder composition comprises:

(a) 90 grams epoxy resin obtained by reaction of epichlorohydrin with bisphenol a. (molecular mass: 1400; epoxide equivalent weight: 850–950; softening point: 90° C.), and (b) 10 grams isocyanate compound (blocked aromatic polyisocyanate with an —N═C═O content equal to 14%; relative density: 1.27)

The particle size of the primer composition is below 80 μm.

3. The surface coating consists of PA-11, in the form of powder with a particle size of between 40 and 200 μm.

The inherent viscosity of the PA-11, measured at 20° C. on a solution containing 0.5 g of polymer in 100 g of m-cresol, is equal to 1.

B. APPLICATION

The primer powder compositions (A.2) is deposited onto the steel plate at ambient temperature by electrostatic spraying with a negative electrostatic charge of 40 kV, the metal surface being at voltage 0.

The substrate thus coated passes through an oven maintained at 380° C., where it resides for 3 min.

Immediately afterwards, it is immersed in a fluidized bed in a dipping vessel containing PA-11 powder (A.3).

After approximately 4 seconds' immersion, the substrate thus coating is withdrawn from the dipping vessel and is then cooled in air after postmelting.

C. MATERIAL CHARACTERISTICS

1. The result is a composite comprising successively:

(a) a sand-blasted steel plate (1 mm thickness), (b) a layer of primer with a mean thickness equal to 20 μm, and (c) a layer of surface coating with a thickness of between 200 and 250 μm.

2. The composite described in C.1) is subjected to an adhesion test performed according to NF standard T 58-112 and the adhesion result obtained is Class 4 (very good adhesion).

The composite described above is subjected to a saline mist aging test performed according to NF standard X 41-002 and after 2,000 hours' test, the adhesion results obtained (again measured according to NF standard T 58-112) are Class 3.5–4 (very good adhesion). Also, the tracking from a cross-shaped notch was 11 mm., and blistering, measured according to ASTM standard D 56(81), was Class 10 (no blistering).

EXAMPLE 2

The test of Example 1 is repeated using various primer powders whose composition comprises:

EXAMPLE 2.A 90 grams epoxy resin obtained by reaction of epichlorihydrin with bisphenol A. (molecular mass: 1400; epoxide equivalent weight: 850–950; softening point: 90° C.), and 10 grams catalysed or micronized dicyandiamide resin.

EXAMPLE 2.B 92.5 grams epoxy resin with the same characteristics as in 2.A, and 7.5 grams phthalic anhydride.

EXAMPLE 2.C 92 grams epoxy resin with the same characteristics as in 2.a, and 8 grams diaminodiphenyl sulphone.

EXAMPLE 2.D 50 grams epoxy resin with the same characteristics as in 2.A, and 50 grams saturated polyester resin (acid value: 70–85; Tg=55° C.)

EXAMPLE 2.E 50 grams epoxy resin with the same characteristics as in 2.A, and 50 grams phenol/aldehyde resin (melting point: 100° C.; aldehyde/phenol: 1.2 (in M): $\overline{M}w$=2,000–3,000)

The metal substrate is a sand-blasted steel plate and the surface coating has the same characteristics as those of Example 1.

The substrate is coated with the primer by electrostatic spraying under the same conditions as in 1.B.

It then passes through an oven maintained at 330° C., where it resides for 10 minutes.

Immediately afterwards, it is immersed in a fluidized bed of the surface coating material in a dipping vessel under the same conditions as those described in 1.B.

The material obtained is a composite comprising successively:

(a) a sand-blasted steel plate (3 mm thickness), (b) a layer of primer with a mean thickness equal to 20 μm, and (c) a layer of surface coating with a thickness of between 200 and 250 μM.

The materials are subjected to an adhesion test carried out according to NF standard T 58-112 and a saline mist aging test carried out according to NF standard X 41-002.

The results obtained are set forth in Table I.

EXAMPLE 3

The test of Example 1 is repeated using a primer powder which comprises (in g):

A. 92 grams modified novolak epoxy resin (epoxide equivalent weight: 500–575; softening point between 90° and 98° C.; d=1.19), and 8 grams micronized dicyandiamide, and B. 100 grams poly-p-vinylphenol of $\overline{M}w$ of between 2000 and 30000, of epoxide equivalent weight=120 and having a softening point of between 140° and 210° C.

The metal substrate and the surface coating have the same characteristics as in Example 2 and the conditions of application and of evaluation of the materials obtained are identical with those described in Example 2.

The results obtained are set forth in Table I.

EXAMPLE 4 (COMPARATIVE)

The test of Example 1 is repeated using a liquid primer which comprises the following resins:

(a) epoxy resin obtained by reaction of epichlorohydrin with bisphenol A, whose molecular mass is between 3000 and 3800 and whose epoxide equivalent weight is between 1600 and 4000, (b) resol-type phenol-formaldehyde resin, and (c) melamine-formaldehyde aminoplastic resin in solution a mixture of ethylene glycol, solvent naphtha, butanol, isobutanol and methyl isobutyl ketone.

The metal substrate and the surface coating material have the same characteristics as those of Example 1.

The application conditions are identical with those described in 1.B.

The material obtained is such that the initial adhesion of the coating is zero (class 0) and the corrosion tracking is complete in a few hours.

EXAMPLE 5 COMPARATIVE

The test of Example 1 is repeated using the primer described in 2A under the operating conditions described in French Patent Application No. 2,340,140, namely the succession of the following stages:

(a) application of the primer (thickness 100 μm) onto a sand-blasted steel plate 1 mm in thickness, using an electrostatic gun (V=−40 kV), (b) heating the powder-covered plate to 200° C. for 3 minutes.

(c) application of polyamide-11 after cooling the plate by electrostatic spraying (V =−40 kV); thickness about 140 μm, and (d) postmelting of the system at 300° C. for 3 minutes.

A two-layer coating is thus obtained, comprising:

(a) an epoxy undercoat (42% of the total coating thickness), and (b) a layer of polyamide, the total coating thickness being equal to 260 μm.

The results obtained in the adhesion and saline mist aging test are given in Table I.

The surface appearance of the coating is fairly poor with, in particular, bubbling on the edges, corresponding to a decomposition of the primer.

TABLE I

| EX No. | EX 2A | EX 2B | EX 2C | EX 2D | EX 2E | EX 3A | EX 3B | EX 5 |
|---|---|---|---|---|---|---|---|---|
| Adhesion t = 0 | 3–4 | 4 | 3 | 3 | 4 | 4 | 3–4 | 3 |
| Adhesion after 1500 h SM | 3–4 | 2 | 3 | 2 | 3–4 | 2 | 3 | 0 |
| Tracking SM | 7 | 10 | 4 | 13 | 7 | 10 | 5 | Total debonding after 500 h |
| Blistering SM 1500 h | 10 | 8M | 10 | 8M | 10 | 10 | 10 | — |

SM = Saline mist

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A process for coating a metal substrate, comprising; prime coating an unheated metal substrate with a dry primer powder, wherein the primer powder is a mixture of a powdered resin and a powdered hardener, heating the substrate coated with the primer powder to a temperature sufficient to melt a surface coating powder, and thereafter contacting the prime coated heated substrate with the surface coating powder.

2. The process of claim 1, wherein the temperature of heating of the primer coated substrate is up to about 380° C.

3. The process of claim 1, wherein the surface coating is a polyamide 11, polyamide 12, a polyetheresteramide, or mixtures thereof.

4. A process for coating a metal substrate, comprising; prime coating an unheated metal substrate with a dry primer powder, wherein the primer powder comprises a powdered resin and a powdered hardener, single heating the substrate coated with the primer powder to a temperature sufficient to crosslink said primer powder and store an effective amount of energy in said substrate to melt a surface coating powder, and thereafter contacting the prime coated substrate with the surface coating powder, wherein said hardener is an acid anhydride or isocyanate based compound.

5. The process for coating a metal substrate of claim 4, herein said temperature is between 270° and 380° C.

6. The process for coating a metal substrate of claim 4, wherein said temperature is between 320° and 380° C.

7. The process of coating a metal substrate of claim 4, wherein said contacting of the prime coated heated substrate with the surface coating powder comprises immersing the prime coated heated substrate in a fluidized bed of the surface coating powder.

8. A process for coating a metal substrate with plastic comprising sequentially prime coating an unheated metal substrate with a dry primer powder, heating the substrate coated with the primer powder to a temperature sufficient to crosslink the primer powder and to melt a surface coating powder, and thereafter contacting the prime coated heated substrate with the surface coating powder.

* * * * *